United States Patent [19]

Renowden

[11] Patent Number: 4,813,610

[45] Date of Patent: Mar. 21, 1989

[54] GASOLINE INJECTOR FOR AN INTERNAL COMBUSTION ENGINE

[75] Inventor: Paul S. Renowden, Hounslow, England

[73] Assignee: Lucas Industries Public Limited Company, Birmingham, England

[21] Appl. No.: 50,065

[22] Filed: May 13, 1987

[30] Foreign Application Priority Data

May 16, 1986 [GB] United Kingdom ..... 8611950

[51] Int. Cl.[4] ..... B05B 1/26

[52] U.S. Cl. ..... 239/499; 239/518; 239/520; 239/533.12; 239/585

[58] Field of Search ..... 123/445, 472, 590; 239/433, 499, 504, 518, 520, 533.12, 543, 544, 585

[56] References Cited

U.S. PATENT DOCUMENTS

| | | | |
|---|---|---|---|
| 1,616,335 | 2/1927 | Rochefort | 239/433 |
| 2,785,926 | 2/1954 | Lataste | 239/543 X |
| 4,218,021 | 8/1980 | Palma | 239/585 |
| 4,666,083 | 5/1987 | Yie | 239/433 X |

FOREIGN PATENT DOCUMENTS

| | | | |
|---|---|---|---|
| 2323846 | 11/1973 | Fed. Rep. of Germany | 239/518 |
| 596448 | 10/1925 | France | 239/518 |
| 47930 | 8/1937 | France | 123/445 |
| 357951 | 4/1938 | Italy | 239/533.12 |
| 578959 | 7/1946 | United Kingdom | 239/585 |
| 2113299 | 8/1983 | United Kingdom | 239/585 |

*Primary Examiner*—Tony M. Argenbright
*Assistant Examiner*—Eric R. Carlberg
*Attorney, Agent, or Firm*—Balogh, Osann, Kramer, Dvorak, Genova & Traub

[57] ABSTRACT

A gasoline injector for an internal combustion engine has an orifice plate in which is formed a pair of outlet orifices through which when a valve means of the injector is operated, flow two jets of gasoline. The jets are directed within an outlet and strike a surface of a deflector member which deflects the jets before they break up to form a spray. The orifice and the surface can be arranged to form a single spray or separate sprays.

2 Claims, 4 Drawing Sheets

GASOLINE INJECTOR FOR AN INTERNAL COMBUSTION ENGINE

This invention relates to a gasoline injector for an internal combustion engine and of the kind including an orifice plate mounted in an injector body, an orifice formed in said plate, valve means for controlling the flow of gasoline through the orifice and a solenoid which can be energised to open said valve means.

Such injectors are well known in the art and are widely used to supply fuel to the inlet manifold or air inlet duct of a spark ignition engine. In use the injectors are supplied with gasoline at a pressure which is very much lower than the pressure at which fuel is supplied to an injection nozzle of a compression ignition engine and as a result there is less energy available for the formation of a fuel spray. The orifice plate is located some distance in from the end of a tubular outlet through which the fuel flows from the orifice before it reaches the air stream. The fuel leaves the orifice as a jet and it is arranged that the jet breaks up to form a spray exterior of the outlet where it can mix with the air flowing to the engine. In some engine installations it is required to produce two sprays of fuel or a single large spray while at the same time using only one injector.

The object of the invention is to provide a gasoline injector in a simple and convenient form.

According to the invention a gasoline injector for supplying fuel to an air inlet of an internal combustion engine comprises an orifice plate mounted at one end of an elongated outlet which in use opens into the air inlet, a pair of orifices formed in said plate, valve means for controlling the flow of gasoline through said orifices, and a deflector surface located in said outlet for engagement by jets of gasoline issuing from said orifices said surface acting to deflect the jets to produce the required spray pattern.

Examples of injector will now be described with reference to the accompanying FIGS. 1–4 each of which is a sectional side elevation of part of the injector.

Figure 1:
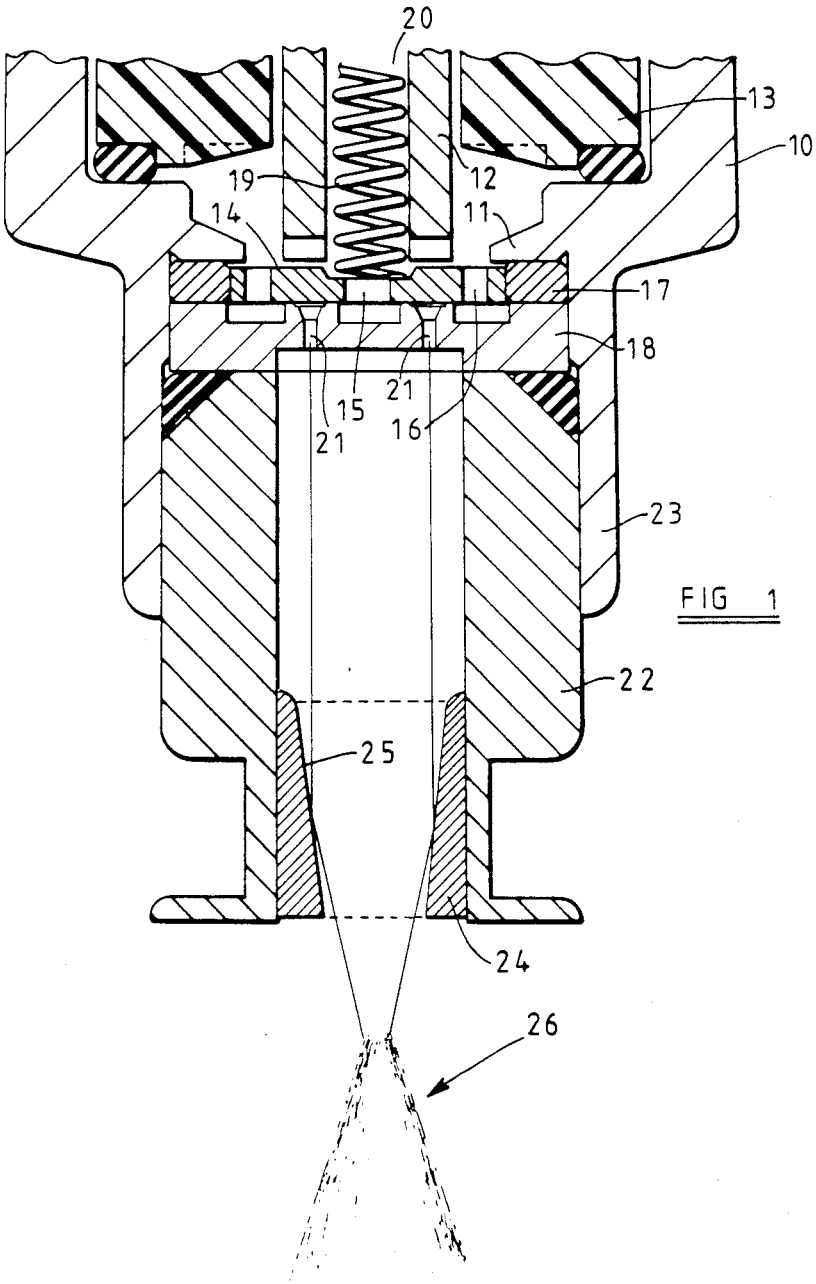

Referring to FIG. 1 of the drawings the injector comprises a hollow body 10 formed from magnetic material and which is formed with an inwardly directed flange 11. Extending within the body is a tubular core member 12 and surrounding the core member is a former 13 on which is wound a solenoid winding which when energised causes the flange 11 and the adjacent end portion of the core member 12 to assume opposite magnetic polarity.

Also provided is a plate-like valve member 14 which has a central aperture 15 and a series of apertures 16 located in a circle about the central aperture. The valve member 14 is guided for movement within an annular spacer member 17 against which is located an orifice plate 18. The valve member is formed from magnetic material and it overlies the presented faces of the core member 12 and a portion of the flange 11 so that when the winding is supplied with electric current, the valve member will be attracted away from the orifice plate against the action of a coiled compression spring 19 which is located within a central passage 20 in the core member. The passage 20 at its end remote from the valve member communicates with a fuel inlet.

Formed in the orifice plate in the example of FIG. 1, are a pair of orifices 21 and in the closed position of the valve member as shown in FIG. 1, the valve plate obturates these orifices. The orifices extend into the interior of a sleeve member 22 which is secured within a tubular extension 23 of the body 10. The sleeve member defines an elongated outlet and it projects into the air inlet manifold or duct of the engine. At the end of the outlet removed from the orifice plate there is mounted a deflector sleeve 24 which has an internal surface 25 which converges towards the outer end of the outlet. The orifices 21 are positioned such that the jets of fuel issuing therefrom will flow generally parallel to the longitudinal axis of the outlet and will strike the surface 25 and will be deflected inwardly. In the example of FIG. 1 the orifices 21 are diametrically disposed so that the two jets of fuel after deflection by the surface 25 will converge towards each other and more or less at the position where they contact each other, the jets start to break up to form a spray. As a result a generally conical well atomised spray 26 is produced which is larger than the spray produced by a single orifice having a larger cone angle, which will quickly mix with air flowing in the inlet manifold or duct.

Figure 2:
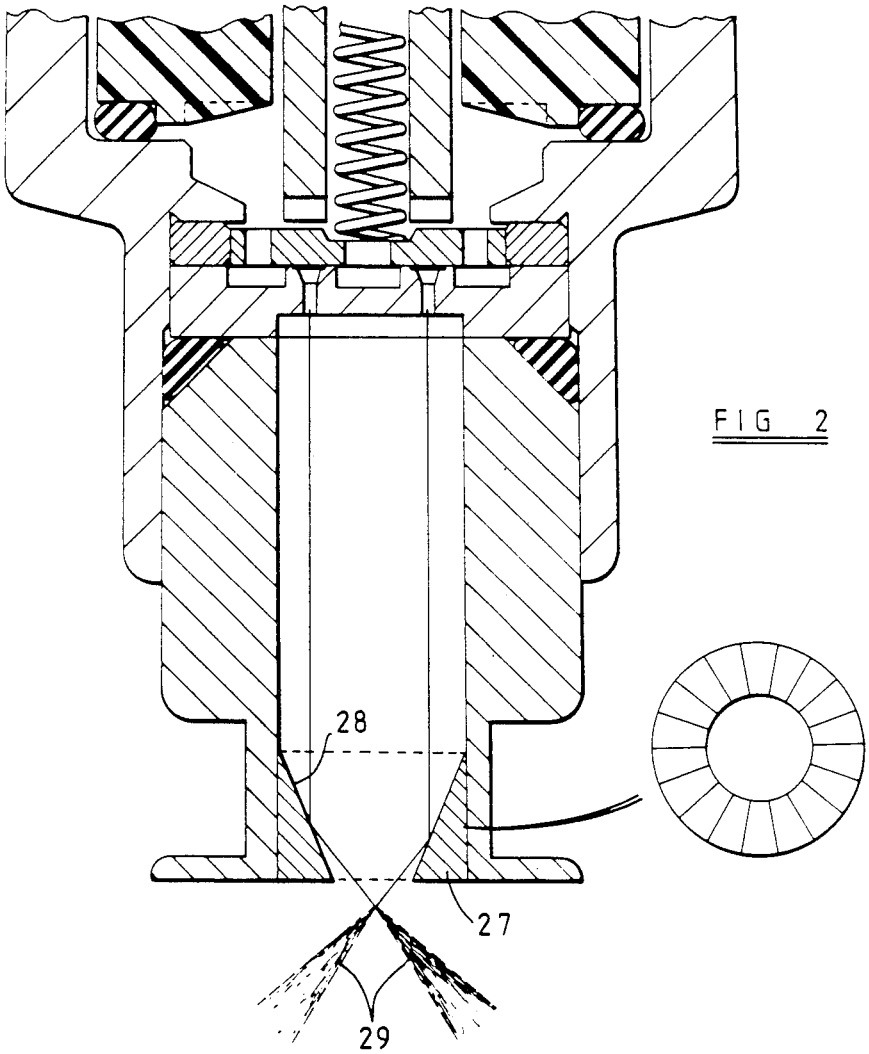

FIG. 2 shows a variation in the injector shown in FIG. 1, the deflector sleeve 27 having an internal surface 28 which inclines inwardly at a steeper angle than the surface 25 in the injector of FIG. 1. As a result the deflection of the two jets is greater and the tendency is for two conical sprays 29 to be produced rather than a single spray 26 as in the example of FIG. 1, the cone angles of the sprays 29 corresponding to the cone angle obtained with a single orifice. This is particularly useful where the gasoline injector is mounted in a duct formed in the cylinder head of the engine and which branches towards a pair of inlet valves. Conveniently the surface 28 of the deflector sleeve is formed as a series of segments as illustrated in the plan view of the deflector sleeve seen in FIG. 2 to assist in causing interaction of the two fuel sprays.

Figure 3:
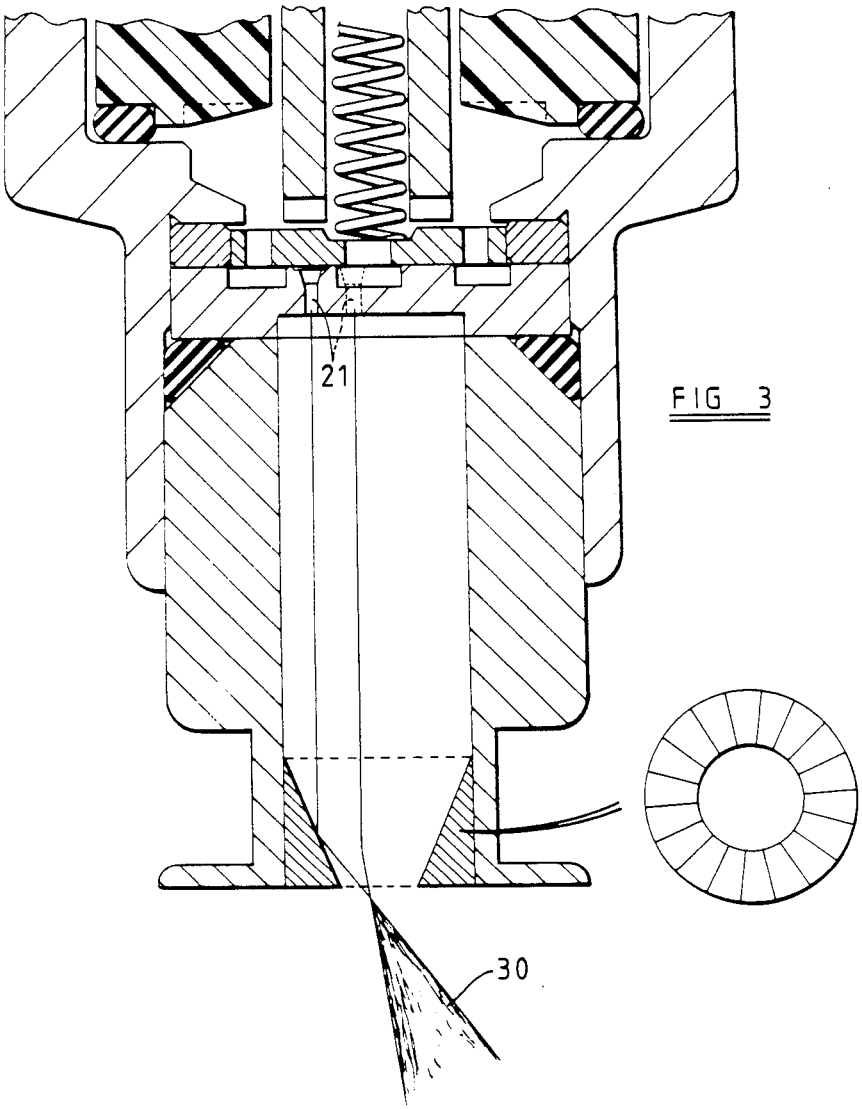

The injector which is seen in FIG. 3 is substantially the same as that which is seen in FIG. 2 with the exception that the orifices 21 are no longer diametrically disposed and the sprays produced by the two jets tend to merge to form a single spray 30 which extends at an angle to the axis of the injector. This may be desirable for engines where it is not convenient to mount the injector along the same axis as the desired fuel spray.

Figure 4:
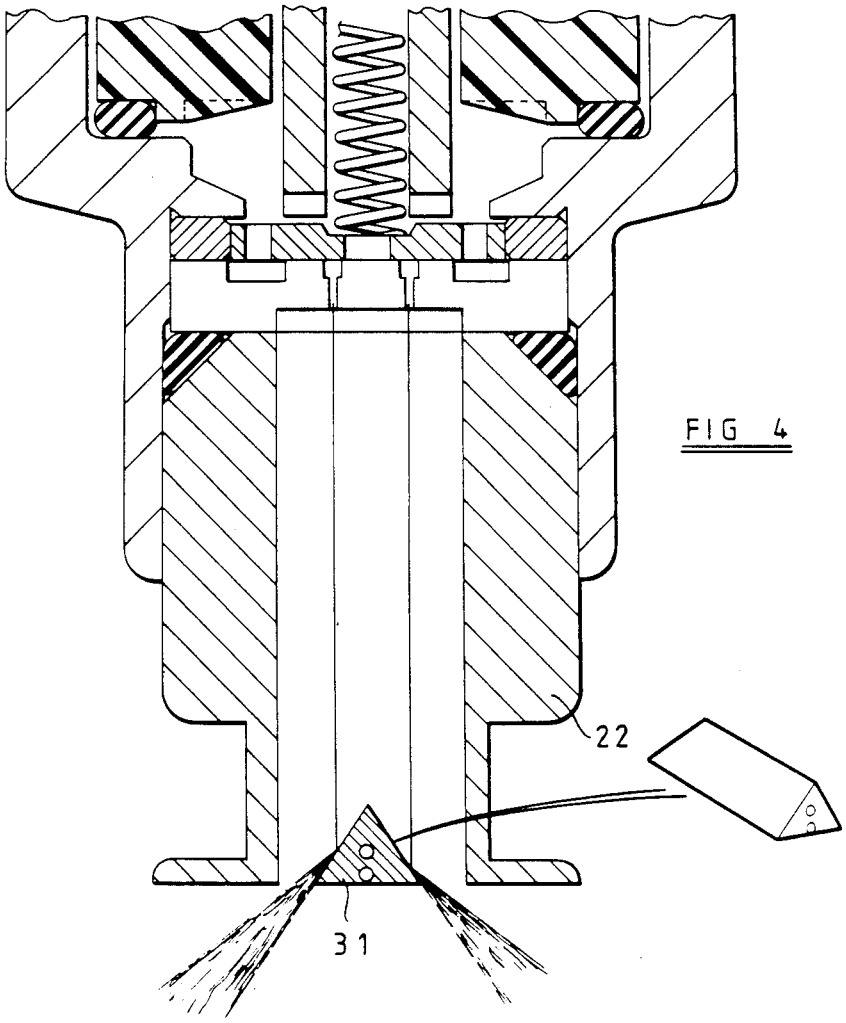

In the injector which is shown in FIG. 4 the deflector sleeve of the earlier examples is omitted and instead a deflector member 31 of triangular form is positioned adjacent the end of the outlet remote from the orifice plate. Conveniently the deflector member 31 is held in position within the end of the sleeve 22 by a pair of pins which extend through the deflector member and the sleeve. The deflector member extends transversely of the outlet formed by the sleeve. The jets strike the surfaces of the deflector member to form a pair of conical fuel sprays which diverge from each other and from the longitudinal axis of the injector.

The drawings illustrate typical angles for the surfaces against which the fuel jets are directed. The actual angles depend upon the injection application.

The surface against which the jets of gasoline impinge may be formed by the internal surface of the sleeve member 22. In this case the orifices 21 are so disposed that the jets of gasoline impinge on the internal surface of the sleeve member at an angle to cause the required deflection of the jets.

I claim:

1. A gasoline injector for supplying fuel to an air inlet of an internal combustion engine comprising an orifice plate member at one end of an elongated outlet which in use opens at its other end into the air inlet, a pair of orifices formed in said plate, valve means for controlling the flow of gasoline through said orifices and a deflector surface located in said outlet for engagement by jets of gasoline issuing from said orifice, said surface acting to deflect the jets to produce the required spray pattern, in which said deflector surface comprises an annular deflector sleeve which is located in said outlet, the sleeve defining an internal surface which converges towards the end of the outlet remote from the orifice plate, and in which said internal surface is divided into a plurality of segments.

2. A gasoline injector for supplying fuel to an air inlet of an internal combustion engine comprising an orifice plate member at one end of an elongated outlet which in use opens at its other end into the air inlet, a pair of orifices formed in said plate, valve means for controlling the flow of gasoline through said orifices and a deflector member of triangular form extending transversely of the outlet, said orifices being positioned so that the jets of gasoline strike two sides respectively of said deflector member at an angle to cause deflection of said jets.

* * * * *